US011100826B2

(12) United States Patent
Xu

(10) Patent No.: US 11,100,826 B2
(45) Date of Patent: Aug. 24, 2021

(54) ADJUSTING METHOD OF DISPLAYING IMAGES

(71) Applicant: Shenzhen China Star Optoelectronics Technology Co., Ltd., Shenzhen (CN)

(72) Inventor: Fengcheng Xu, Shenzhen (CN)

(73) Assignee: SHENZHEN CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 376 days.

(21) Appl. No.: 16/309,449

(22) PCT Filed: Sep. 14, 2018

(86) PCT No.: PCT/CN2018/105654
§ 371 (c)(1),
(2) Date: Dec. 12, 2018

(87) PCT Pub. No.: WO2019/205441
PCT Pub. Date: Oct. 31, 2019

(65) Prior Publication Data

US 2021/0097907 A1 Apr. 1, 2021

(30) Foreign Application Priority Data

Apr. 28, 2018 (CN) ..... 201810402219.2

(51) Int. Cl.
*G09G 3/00* (2006.01)
*G09G 3/20* (2006.01)

(52) U.S. Cl.
CPC ..... *G09G 3/006* (2013.01); *G09G 3/20* (2013.01); *G09G 2300/0443* (2013.01); *G09G 2310/027* (2013.01); *G09G 2310/08* (2013.01); *G09G 2320/0233* (2013.01); *G09G 2320/0626* (2013.01)

(58) Field of Classification Search
CPC combination set(s) only.
See application file for complete search history.

(56) References Cited

U.S. PATENT DOCUMENTS

2008/0309602 A1* 12/2008 Hwang ..... G09G 3/006 345/89
2014/0184671 A1* 7/2014 Lee ..... G09G 3/006 345/697

FOREIGN PATENT DOCUMENTS

CN 104464637 A 3/2015
CN 105575350 A 5/2016
GN 101354872 A 1/2009
(Continued)

*Primary Examiner* — Robin J Mishler
(74) *Attorney, Agent, or Firm* — Leong C. Lei

(57) ABSTRACT

Provided are an adjusting method of displaying images. The adjusting method use obtaining a coordinate of the defect of the images displayed by the display panel in the vertical lines and a type of the defect in the vertical lines, and adjusting grayscale value of the data signals of the pixels of one row by the timing controller corresponding to the coordinate of the defect of the vertical line in the outputted matrix of the pixels according to the type of the defect in the vertical lines, such that the voltage of the data signals outputted from the source driver to the pixels of the row is changed, and a brightness of the pixels of the row is the same as a brightness of the pixels of two adjacent rows.

13 Claims, 2 Drawing Sheets

(56) References Cited

FOREIGN PATENT DOCUMENTS

| | | | |
|---|---|---|---|
| GN | 103489420 | A | 1/2014 |
| GN | 107767807 | A | 3/2018 |

* cited by examiner

ADJUSTING METHOD OF DISPLAYING IMAGES

CROSS-REFERENCE TO RELATED APPLICATION

Field of the Invention

The present disclosure relates to a display field, and more particularly to an adjusting method of displaying images.

BACKGROUND OF THE INVENTION

In the display field, a cathode ray tube (CRT) has been gradually replaced by a flat display device like a liquid crystal display (LCD) or an organic light-emitting diode (OLED). The LCD has advantages of thin frame, low power, and low radiation, and has been widely used.

Most LCDs in the market are the type of backlight-LCDs that include LCD panels and backlight modules. The LCD panel includes a color filter (CF) substrate, a thin film transistor (TFT) substrate, a liquid crystal (LC) between the CF substrate and the TFT substrate, and a sealant. The operating principle of the LCD panel is that the liquid crystal molecules are disposed between two glasses being parallel with each other. A plurality of vertical and horizontal tiny wires are within two glass substrates. Voltages are applied to control the liquid crystal molecule to change orientation to refract the light of the backlight module to produce images.

The OLED usually includes: a substrate, an anode disposed on the substrate, a hole inject layer (HIL) disposed on the anode, a light emitting layer disposed on the HIL, an electron transport layer (ETL) disposed on the light emitting layer, an electron inject layer (EIL) disposed on the ETL, and a cathode disposed on the EIL. The operating principle of the LCD panel is that by applying the electric field to drive the semiconductor material and the organic light emitting layer, the charger carrier is injected in the composite material to emit light. Specifically, the OLED usually utilizes an ITO electrode and a metal electrode as the anode and the cathode, respectively. By applying a certain voltage, electrons and holes are injected into the ETL and the HTL, respectively. The electrons and the holes are transported to the light emitting layer via the ETL and the HTL, respectively, to form activators to activate light emitting molecules. The light emitting molecules emit the visible light by radiation relaxation.

With development of the displaying technology, large scale display panels are widely used by the customers. Due that the large scale display panels have large dimension, the consistence within the panel is poor, resulting in that the display panel has various mura and line defect. The solution to solve the mura of the display panel is demura. However, due of the precision, the issue about defects of vertical lines including a vertical poor-line and a vertical bright-line cannot be solved by the demura apparatus. The defect of the vertical poor-line is that a brightness of the pixels of one row is lower than a brightness of the pixels of two adjacent row, resulting in the vertical poor-line. The defect of the vertical bright-line is that a brightness of the pixels of one row is higher than a brightness of the pixels of two adjacent row, resulting in the vertical bright-line. The defect of the vertical lines highly affects the display quality.

SUMMARY OF THE INVENTION

The present disclosure relates to an adjusting method of displaying images, which can eliminate a defect of images in vertical lines, so as to improve displaying quality.

In one aspect, an adjusting method of displaying images is provided. The adjusting method includes: step S1: providing a display device; the display device including a display panel, a source driver electrically connected with the display panel, and a timing controller electrically connected with the source driver; the display panel including a plurality of pixels arranged in a matrix; and the source driver being electrically connected with the pixels; step S2: providing data signals to the source driver by the timing controller, such that the source driver outputs the same voltages of the data signals to the pixels, to drive the display panel to display the images, wherein the images displayed by the display panel have a defect in vertical lines; step S3: obtaining a coordinate of the defect of the images displayed by the display panel in the vertical lines and a type of the defect in the vertical lines; and step S4: adjusting grayscale value of the data signals of the pixels of one row corresponding to the coordinate of the defect of the vertical line in the outputted matrix of the pixels according to the type of the defect in the vertical lines by the timing controller, such that the voltage of the data signals outputted from the source driver to the pixels of the row is changed, and a brightness of the pixels of the row is the same as a brightness of the pixels of two adjacent rows.

Wherein in the step S3, the defect of the vertical lines is a vertical poor-line; and in the step S4, the timing controller increases the grayscale value of the data signals of the pixels of the row corresponding to the coordinate of the defect of the vertical line in the outputted matrix of the pixels upon determining the vertical poor-line, such that voltage of the data signals outputted from the source driver to the pixels of the row is increased, and the brightness of the pixels of the row is the same as the brightness of the pixels of two adjacent rows.

Wherein in the step S3, the defect of the vertical lines is a vertical bright-line; and in the step S4, the timing controller decreases the grayscale value of the data signals of the pixels of the row corresponding to the coordinate of the defect of the vertical line in the outputted matrix of the pixels upon determining the vertical bright-line, such that voltage of the data signals outputted from the source driver to the pixels of the row is decreased, and the brightness of the pixels of the row is the same as the brightness of the pixels of two adjacent rows.

Wherein in the step S3, the timing controller detects the display panel to obtain the coordinate of the defect of the images displayed by the display panel in the vertical lines and detects the type of the defect of the vertical lines.

Wherein in the step S3, an external calculator detects the display panel to obtain the coordinate of the defect of the images displayed by the display panel in the vertical lines and the type of the defect of the vertical lines, and transmits the coordinate of the defect of the images displayed by the display panel in the vertical lines and the type of the defect of the vertical lines to the timing controller.

Wherein the step S4 further includes storing at least one adjusting value relating to an adjustment conducted by the timing controller to adjust the grayscale values of the data signals of the pixels of one row corresponding to the coordinate of the defect of the vertical line in the outputted matrix of the pixels according to the type of the defect in the vertical lines.

Wherein the display device further includes a storage unit electrically connected with the timing controller, and the storage unit stores the adjusting values configured for adjusting the grayscale values of the data signals of the pixels of the row corresponding to the coordinate of the defect of the vertical line in the outputted matrix of the pixels according to the type of the defect in the vertical lines.

Wherein each of the pixels includes a plurality of sub-pixels being sequentially arranged, the display panel further includes a plurality of rows of data lines respectively connected with a plurality of rows of the sub-pixels, and the rows of data lines are connected with the source driver.

Wherein in the step S2, the source driver outputs the same voltages of the data signals to the sub-pixels of the plurality of pixels via the data lines.

Wherein in the step S4, the timing controller adjusts the grayscale value of the data signals of the pixels of the row corresponding to the coordinate of the defect of the vertical line in the outputted matrix of the pixels, such that the brightness of the rows of the sub-pixels of the pixel of the row is the same as the brightness of the rows of the sub-pixels of the pixels of the two adjacent rows.

In another aspect, an adjusting method of displaying images is provided. The adjusting method includes: step S1: providing a display device; the display device including a display panel, a source driver electrically connected with the display panel, and a timing controller electrically connected with the source driver; the display panel comprising a plurality of pixels arranged in a matrix; and the source driver being electrically connected with the pixels; step S2: providing data signals to the source driver by the timing controller, such that the source driver outputs the same voltages of the data signals to the pixels, to drive the display panel to display the images, wherein the images displayed by the display panel have a defect in vertical lines; step S3: obtaining a coordinate of the defect of the images displayed by the display panel in the vertical lines and a type of the defect in the vertical lines; and step S4: adjusting grayscale value of the data signals of the pixels of one row corresponding to the coordinate of the defect of the vertical line in the outputted matrix of the pixels according to the type of the defect in the vertical lines, such that the voltage of the data signals outputted from the source driver to the pixels of the row is changed, and a brightness of the pixels of the row is the same as a brightness of the pixels of two adjacent rows. Wherein each of the pixels includes a plurality of sub-pixels being sequentially arranged, the display panel further includes a plurality of rows of data lines respectively connected with a plurality of rows of the sub-pixels, and the rows of data lines are connected with the source driver. Wherein in the step S2, the source driver outputs the same voltages of the data signals to the sub-pixels of the plurality of pixels via the data lines. Wherein in the step S4, the timing controller adjusts the grayscale value of the data signals of the pixels of the row corresponding to the coordinate of the defect of the vertical line in the outputted matrix of the pixels, such that the brightness of the rows of the sub-pixels of the pixel of the row is the same as the brightness of the rows of the sub-pixels of the pixels of the two adjacent rows. Wherein the step S4 further includes storing at least one adjusting value relating to an adjustment conducted by the timing controller to adjust the grayscale values of the data signals of the pixels of one row corresponding to the coordinate of the defect of the vertical line in the outputted matrix of the pixels according to the type of the defect in the vertical lines. Wherein the display device further includes a storage unit electrically connected with the timing controller, and the storage unit store the adjusting values configured for adjusting the grayscale values of the data signals of the pixels of the row corresponding to the coordinate of the defect of the vertical line in the outputted matrix of the pixels according to the type of the defect in the vertical lines.

In view of the above, the present disclosure uses obtaining a coordinate of the defect of the images displayed by the display panel in the vertical lines and a type of the defect in the vertical lines, and adjusting grayscale value of the data signals of the pixels of one row by the timing controller corresponding to the coordinate of the defect of the vertical line in the outputted matrix of the pixels according to the type of the defect in the vertical lines, such that the voltage of the data signals outputted from the source driver to the pixels of the row is changed, and a brightness of the pixels of the row is the same as a brightness of the pixels of two adjacent rows, so as to eliminate a defect of images in vertical lines, and improve displaying quality.

BRIEF DESCRIPTION OF THE DRAWINGS

In order to more clearly illustrate the embodiments of the present invention or prior art, the following figures will be described in the embodiments are briefly introduced. It is obvious that the drawings are merely some embodiments of the present invention, those of ordinary skill in this field can obtain other figures according to these figures without paying the premise.

DETAILED DESCRIPTION OF PREFERRED EMBODIMENTS

The following descriptions for the respective embodiments are specific embodiments capable of being implemented for illustrations of the present invention with referring to appended figures.

Above are embodiments of the present invention, which does not limit the scope of the present invention. Any equivalent amendments within the spirit and principles of the embodiment described above should be covered by the protected scope of the invention.

Figure 1:
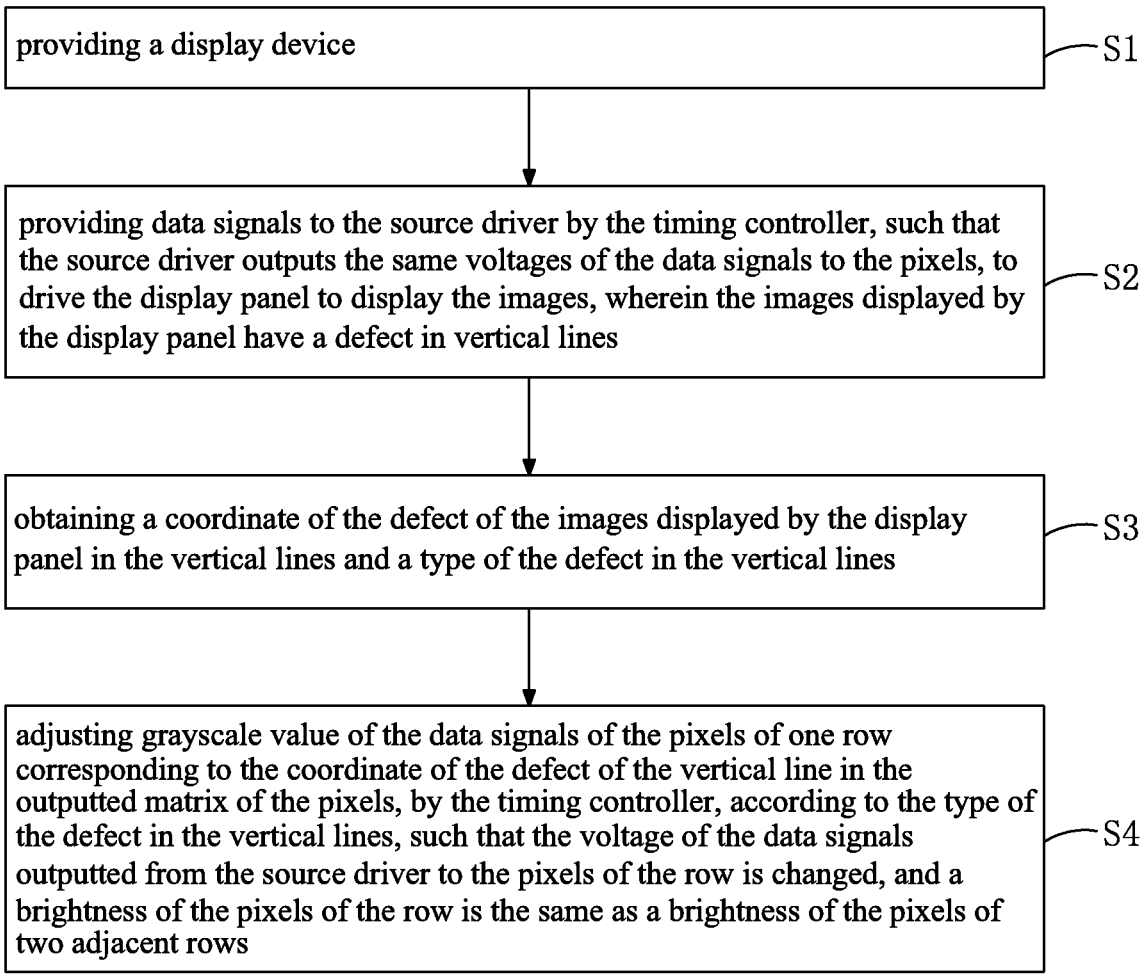
FIG. 1 is a flowchart of an adjusting method of displaying images in accordance with one embodiment of the present disclosure.
Figure 2:
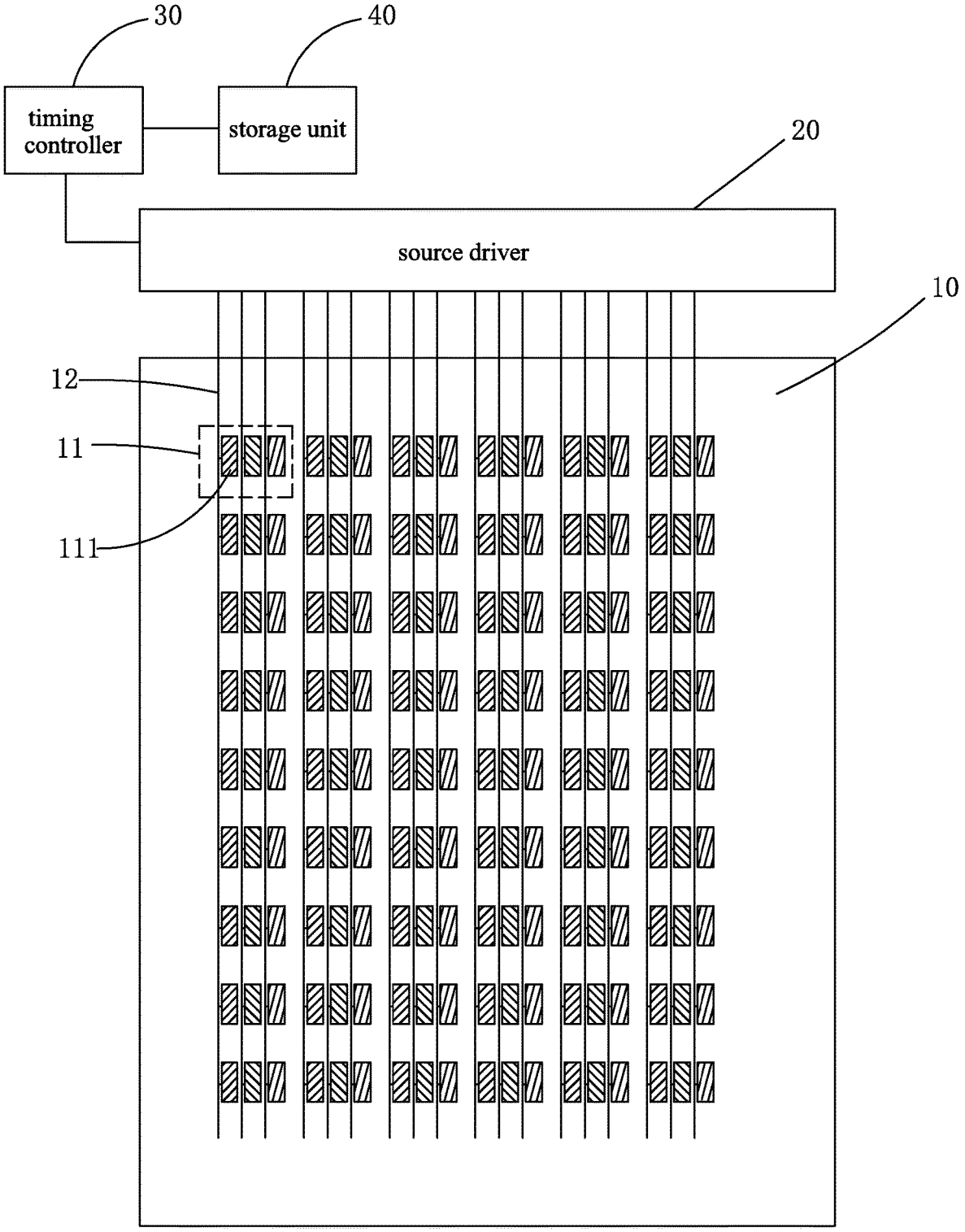
FIG. 2 is a schematic diagram of step S1 of the adjusting method of displaying images in accordance with the embodiment of the present disclosure.

FIG. 1 is a flow chart of an adjusting method of displaying images in accordance with one embodiment of the present disclosure. The adjusting method includes the following steps:

Step S1, referring to FIG. 2, providing a display device.

The display device including a display panel 10, a source driver 20 electrically connected with the display panel 10, and a timing controller 30 electrically connected with the source driver 20. The display panel 10 including a plurality of pixels 11 arranged in a matrix; and the source driver 20 being electrically connected with the pixels 11.

Specifically, each of the pixels 11 includes a plurality of sub-pixels 111 being sequentially arranged. The display panel 10 further includes a plurality of rows of data lines 12 respectively connected with a plurality of rows of the sub-pixels 111, and the rows of data lines 12 are connected with the source driver 20. In the embodiment of FIG. 2, each of the pixels 11 includes three sub-pixels 111 being sequentially arranged. The three sub-pixels 111 are sequentially red sub-pixel, green sub-pixel, and blue sub-pixel.

Step S2: providing data signals to the source driver 20 by the timing controller 30, such that the source driver 20 outputs the same voltages of the data signals to the pixels 11, to drive the display panel 10 to display the images, wherein the images displayed by the display panel 10 have a defect in vertical lines.

Specifically, in the step S2, the timing controller 30 respectively provides a plurality of data signals corresponding to a plurality of rows of pixels 11, and the data signals corresponding to the pixels of one row is the same as the data signals corresponding to the pixels of another row, such that the data signals are outputted to the source driver 20, and the source driver 20 outputs the same voltages of the data signals to the sub-pixels 111 of the plurality of pixels 11 via the data lines 12.

Step S3: obtaining a coordinate of the defect of the images displayed by the display panel 10 in the vertical lines and a type of the defect in the vertical lines.

Specifically, due that the timing controller applied in the display device has cursor function, after the timing controller is electrically connected with the display panel, when the timing controller drives the display panel to display, the timing controller may detect the display panel to obtain the coordinate of the defect of the images displayed by the display panel in the vertical lines and detects that the defect of the vertical lines is a vertical poor-line or a vertical bright-line. Therefore, in the step S3 of the present disclosure, the timing controller 30 may be utilized to detect the display panel 10 to obtain the coordinate of the defect of the images displayed by the display panel 10 in the vertical lines and detects that the defect of the vertical lines is a vertical poor-line or a vertical bright-line.

In another embodiment, in the step S3, an external calculator of a testing apparatus may be utilized to detect the display panel 10 to obtain the coordinate of the defect of the images displayed by the display panel 10 in the vertical lines and the type of the defect of the vertical lines, and transmits the coordinate of the defect of the images displayed by the display panel 10 in the vertical lines and the type of the defect of the vertical lines to the timing controller 30.

Step S4: adjusting grayscale value of the data signals of the pixels 11 of one row corresponding to the coordinate of the defect of the vertical line in the outputted matrix of the pixels 11, by the timing controller 30, according to the type of the defect in the vertical lines, such that the voltage of the data signals outputted from the source driver 20 to the pixels 11 of the row is changed, and a brightness of the pixels of the row is the same as a brightness of the pixels of two adjacent rows.

Specifically, in the step S4, the timing controller 30 adjusts the grayscale value of the data signals of the pixels 11 of the row corresponding to the coordinate of the defect of the vertical line in the outputted matrix of the pixels 11, such that the voltage of the data signals outputted from the source driver 20 to the rows of sub-pixels 111 of the pixels 11 of the row is changed, and the brightness of the rows of the sub-pixels 111 of the pixel 11 of the row is the same as the brightness of the rows of the sub-pixels 111 of the pixels 11 of the two adjacent rows.

Specifically, when, in the step S3, the defect of the vertical lines is a vertical poor-line, in the step S4, the timing controller 30 increases the grayscale value of the data signals of the pixels 11 of the row corresponding to the coordinate of the defect of the vertical line in the outputted matrix of the pixels 11 upon determining the vertical poor-line, such that voltage of the data signals outputted from the source driver 20 to the pixels 11 of the row is increased, and the brightness of the pixels 11 of the row is the same as the brightness of the pixels 11 of two adjacent rows. When, in the step S3, the defect of the vertical lines is a vertical bright-line, in the step S4, the timing controller 30 decreases the grayscale value of the data signals of the pixels 11 of the row corresponding to the coordinate of the defect of the vertical line in the outputted matrix of the pixels 11 upon determining the vertical bright-line, such that voltage of the data signals outputted from the source driver 20 to the pixels 11 of the row is decreased, and the brightness of the pixels 11 of the row is the same as the brightness of the pixels 11 of two adjacent rows.

Specifically, the step S4 further includes storing at least one adjusting value relating to an adjustment conducted by the timing controller 30 to adjust the grayscale values of the data signals of the pixels 11 of one row corresponding to the coordinate of the defect of the vertical line in the outputted matrix of the pixels 11 according to the type of the defect in the vertical lines.

Furthermore, referring to FIG. 2, the display device further includes a storage unit 40 electrically connected with the timing controller 30. The storage unit 40 stores the adjusting values configured for adjusting the grayscale values of the data signals of the pixels 11 of the row corresponding to the coordinate of the defect of the vertical line in the outputted matrix of the pixels according to the type of the defect in the vertical lines to compensate the display panel 10 while displaying images.

It should be understood that the present disclosure uses the timing controller 30 and the source driver 20 to provide the same voltages of the data signals to the pixels 11, to drive the display panel 10 to display the images, in this moment, to obtain a coordinate of the defect of the images displayed by the display panel 10 in the vertical lines and a type of the defect in the vertical lines. Afterwards, the timing controller 30 adjusts grayscale value of the data signals of the pixels 11 of one row corresponding to the coordinate of the defect of the vertical line in the outputted matrix of the pixels 11 according to the type of the defect in the vertical lines, such that the voltage of the data signals outputted from the source driver 20 to the pixels 11 of the row is changed, and a brightness of the pixels 11 of the row is the same as a brightness of the pixels 11 of two adjacent rows, so as to eliminate a defect of images in vertical lines, and improve displaying quality. Furthermore, it has low cost and possibility of productivity to use the timing controller 30 to make the adjustment when displaying images.

In view of the above, the present disclosure uses obtaining a coordinate of the defect of the images displayed by the display panel in the vertical lines and a type of the defect in the vertical lines, and adjusting grayscale value of the data signals of the pixels of one row by the timing controller corresponding to the coordinate of the defect of the vertical line in the outputted matrix of the pixels according to the type of the defect in the vertical lines, such that the voltage of the data signals outputted from the source driver to the pixels of the row is changed, and a brightness of the pixels of the row is the same as a brightness of the pixels of two adjacent rows, so as to eliminate a defect of images in vertical lines, and improve displaying quality.

What is claimed is:

1. An adjusting method of displaying images, comprising:

step S1: providing a display device; the display device comprising a display panel, a source driver electrically connected with the display panel, and a timing controller electrically connected with the source driver; the display panel comprising a plurality of pixels arranged in a matrix; and the source driver being electrically connected with the pixels;

step S2: providing data signals to the source driver by the timing controller, such that the source driver outputs the same voltages of the data signals to the pixels, to drive the display panel to display the images, wherein the images displayed by the display panel have a defect in vertical lines;

step S3: obtaining a coordinate of the defect of the images displayed by the display panel in the vertical lines and a type of the defect in the vertical lines; and step S4: adjusting grayscale value of the data signals of the pixels of one row corresponding to the coordinate of the defect of the vertical line in the outputted matrix of the pixels, by the timing controller, according to the type of the defect in the vertical lines, such that the voltage of the data signals outputted from the source driver to the pixels of the row is changed, and a brightness of the pixels of the row is the same as a brightness of the pixels of two adjacent rows, wherein in the step S3, the timing controller detects the display panel to obtain the coordinate of the defect of the images displayed by the display panel in the vertical lines and detects the type of the defect of the vertical lines, wherein the detection of the coordinate of the defect and the type of the defect is performed through a cursor function of the timing controller and defect detection and grayscale adjustment are both performed by the timing controller.

2. The adjusting method as claimed in claim 1, wherein in the step S3, the defect of the vertical lines is a vertical poor-line; and in the step S4, the timing controller increases the grayscale value of the data signals of the pixels of the row corresponding to the coordinate of the defect of the vertical line in the outputted matrix of the pixels upon determining the vertical poor-line, such that voltage of the data signals outputted from the source driver to the pixels of the row is increased, and the brightness of the pixels of the row is the same as the brightness of the pixels of two adjacent rows.

3. The adjusting method as claimed in claim 1, wherein in the step S3, the defect of the vertical lines is a vertical bright-line; and in the step S4, the timing controller decreases the grayscale value of the data signals of the pixels of the row corresponding to the coordinate of the defect of the vertical line in the outputted matrix of the pixels upon determining the vertical bright-line, such that voltage of the data signals outputted from the source driver to the pixels of the row is decreased, and the brightness of the pixels of the row is the same as the brightness of the pixels of two adjacent rows.

4. The adjusting method as claimed in claim 1, wherein in the step S3, an external calculator detects the display panel to obtain the coordinate of the defect of the images displayed by the display panel in the vertical lines and the type of the defect of the vertical lines, and transmits the coordinate of the defect of the images displayed by the display panel in the vertical lines and the type of the defect of the vertical lines to the timing controller.

5. The adjusting method as claimed in claim 1, wherein the step S4 further comprises storing at least one adjusting value relating to an adjustment conducted by the timing controller to adjust the grayscale values of the data signals of the pixels of one row corresponding to the coordinate of the defect of the vertical line in the outputted matrix of the pixels according to the type of the defect in the vertical lines.

6. The adjusting method as claimed in claim 5, wherein the display device further comprises a storage unit electrically connected with the timing controller, and the storage unit store the adjusting values configured for adjusting the grayscale values of the data signals of the pixels of the row corresponding to the coordinate of the defect of the vertical line in the outputted matrix of the pixels according to the type of the defect in the vertical lines.

7. The adjusting method as claimed in claim 1, wherein each of the pixels comprises a plurality of sub-pixels being sequentially arranged, the display panel further comprises a plurality of rows of data lines respectively connected with a plurality of rows of the sub-pixels, and the rows of data lines are connected with the source driver.

8. The adjusting method as claimed in claim 7, wherein in the step S2, the source driver outputs the same voltages of the data signals to the sub-pixels of the plurality of pixels via the data lines.

9. The adjusting method as claimed in claim 7, wherein in the step S4, the timing controller adjusts the grayscale value of the data signals of the pixels of the row corresponding to the coordinate of the defect of the vertical line in the outputted matrix of the pixels, such that the brightness of the rows of the sub-pixels of the pixel of the row is the same as the brightness of the rows of the sub-pixels of the pixels of the two adjacent rows.

10. An adjusting method of displaying images, comprising:

step S1: providing a display device; the display device comprising a display panel, a source driver electrically connected with the display panel, and a timing controller electrically connected with the source driver; the display panel comprising a plurality of pixels arranged in a matrix; and the source driver being electrically connected with the pixels;

step S2: providing data signals to the source driver by the timing controller, such that the source driver outputs the same voltages of the data signals to the pixels, to drive the display panel to display the images, wherein the images displayed by the display panel have a defect in vertical lines;

step S3: obtaining a coordinate of the defect of the images displayed by the display panel in the vertical lines and a type of the defect in the vertical lines; and step S4: adjusting grayscale value of the data signals of the pixels of one row corresponding to the coordinate of the defect of the vertical line in the outputted matrix of the pixels, by the timing controller, according to the type of the defect in the vertical lines, such that the voltage of the data signals outputted from the source driver to the pixels of the row is changed, and a brightness of the pixels of the row is the same as a brightness of the pixels of two adjacent rows;

wherein each of the pixels comprises a plurality of sub-pixels being sequentially arranged, the display panel further comprises a plurality of rows of data lines respectively connected with a plurality of rows of the sub-pixels, and the rows of data lines are connected with the source driver;

wherein in the step S2, the source driver outputs the same voltages of the data signals to the sub-pixels of the plurality of pixels via the data lines;

wherein in the step S4, the timing controller adjusts the grayscale value of the data signals of the pixels of the row corresponding to the coordinate of the defect of the vertical line in the outputted matrix of the pixels, such that the brightness of the rows of the sub-pixels of the pixel of the row is the same as the brightness of the rows of the sub-pixels of the pixels of the two adjacent rows;

wherein the step S4 further comprises storing at least one adjusting value relating to an adjustment conducted by the timing controller to adjust the grayscale values of the data signals of the pixels of one row corresponding to the coordinate of the defect of the vertical line in the outputted matrix of the pixels according to the type of the defect in the vertical lines, and wherein in the step S3, the timing controller detects the display panel to obtain the coordinate of the defect of the images displayed by the display panel in the vertical lines and detects the type of the defect of the vertical lines, wherein the detection of the coordinate of the defect and the type of the defect is performed through a cursor function of the timing controller and defect detection and grayscale adjustment are both performed by the timing controller.

11. The adjusting method as claimed in claim 10, wherein in the step S3, the defect of the vertical lines is a vertical poor-line; and in the step S4, the timing controller increases the grayscale value of the data signals of the pixels of the row corresponding to the coordinate of the defect of the vertical line in the outputted matrix of the pixels upon determining the vertical poor-line, such that voltage of the data signals outputted from the source driver to the pixels of the row is increased, and the brightness of the pixels of the row is the same as the brightness of the pixels of two adjacent rows.

12. The adjusting method as claimed in claim 10, wherein in the step S3, the defect of the vertical lines is a vertical bright-line; and in the step S4, the timing controller decreases the grayscale value of the data signals of the pixels of the row corresponding to the coordinate of the defect of the vertical line in the outputted matrix of the pixels upon determining the vertical bright-line, such that voltage of the data signals outputted from the source driver to the pixels of the row is decreased, and the brightness of the pixels of the row is the same as the brightness of the pixels of two adjacent rows.

13. The adjusting method as claimed in claim 10, wherein in the step S3, an external calculator detects the display panel to obtain the coordinate of the defect of the images displayed by the display panel in the vertical lines and the type of the defect of the vertical lines, and transmits the coordinate of the defect of the images displayed by the display panel in the vertical lines and the type of the defect of the vertical lines to the timing controller.

* * * * *